US006808653B1

(12) United States Patent
Müller et al.

(10) Patent No.: US 6,808,653 B1
(45) Date of Patent: Oct. 26, 2004

(54) PROCESS AND APPARATUS FOR THE UTILIZATION OF NITROGEN-ORGANIC COMPONDS BY GASIFICATION

(75) Inventors: Ulrich Müller, Freiberg (DE); Uwe Gaudig, Merseburg (DE); Jürgen Görz, Freiberg (DE); Manfred Schingnitz, Freiberg (DE); Norbert Fischer, Lichtenberg (DE); Wolfgang Seidel, Oberbobritzsch (DE)

(73) Assignee: Future Energy GmbH, Freiberg (DE)

( * ) Notice: Subject to any disclaimer, the term of this patent is extended or adjusted under 35 U.S.C. 154(b) by 511 days.

(21) Appl. No.: 09/711,463

(22) Filed: Nov. 13, 2000

(30) Foreign Application Priority Data

Nov. 11, 1999 (DE) ..... 199 54 188

(51) Int. Cl.[7] ..... A62D 3/00
(52) U.S. Cl. ..... 252/374; 588/205; 588/220
(58) Field of Search ..... 252/374; 588/205, 588/220

(56) References Cited

U.S. PATENT DOCUMENTS 5,347,068 A 9/1994 Rabe et al.
5,449,854 A 9/1995 Yap
5,968,212 A * 10/1999 Peise et al. ..... 48/101

FOREIGN PATENT DOCUMENTS

DE 43 28 188 2/1995
DE 44 46 803 6/1996

* cited by examiner

*Primary Examiner*—Steven Bos
*Assistant Examiner*—Jonas N. Strickland
(74) *Attorney, Agent, or Firm*—Cohen, Pontani, Lieberman & Pavane

(57) ABSTRACT

The invention relates to a process for the utilization of a feedstock essentially comprising nitrogen-organic compounds, in which the utilization takes place by gasifying the feedstock under normal pressure or an increased pressure, up to 40 bar, at temperatures at least about 900° C., and preferably between 1100° C., and 1600° C., by partial oxidation using a gasifying medium containing free oxygen, as a flame reaction in an entrained bedgasifier. An apparatus for carrying out the process is described.

7 Claims, 1 Drawing Sheet

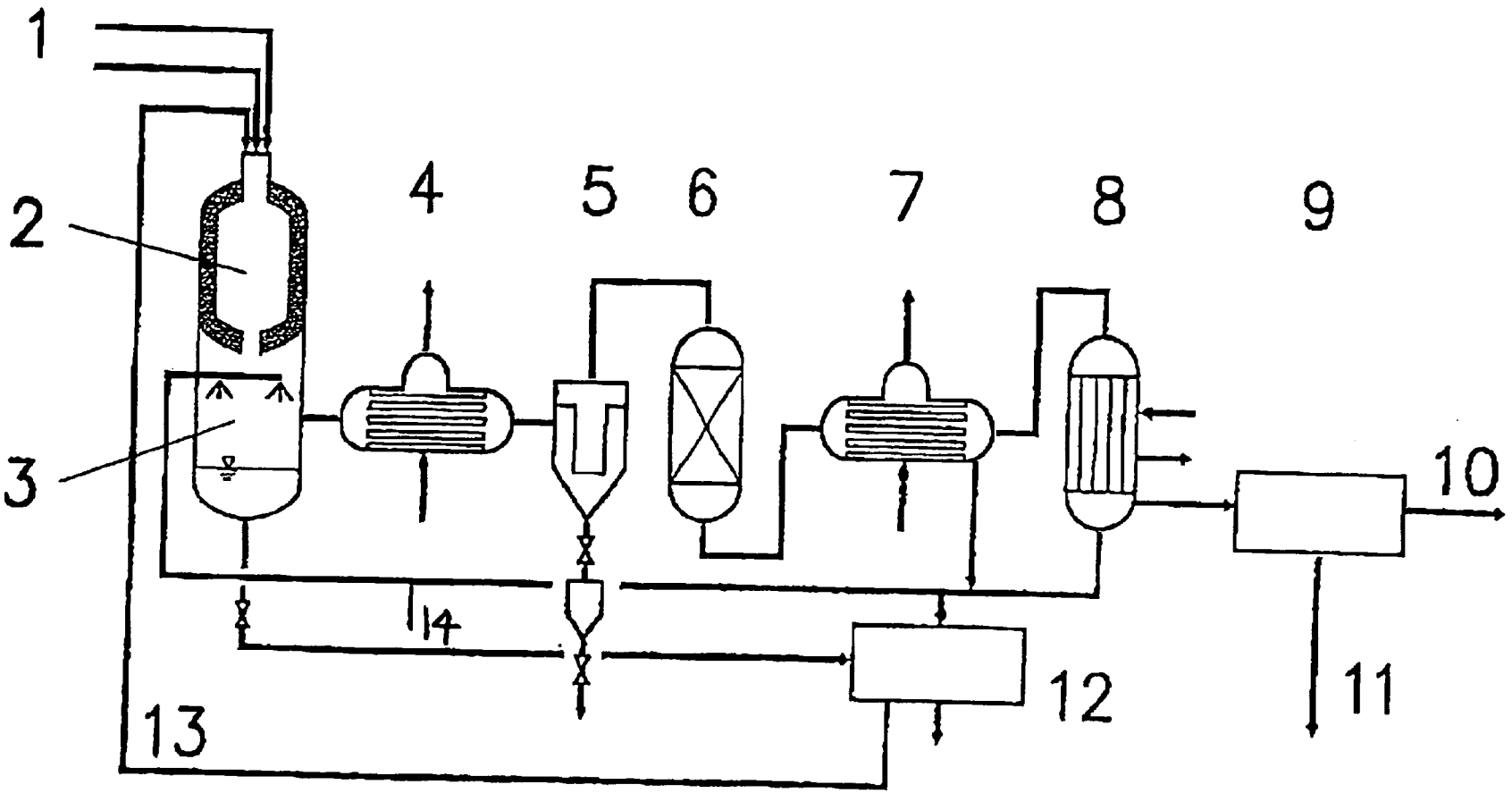
1
2
3
4
5
6
7
8
9
10
11
12
13
14

PROCESS AND APPARATUS FOR THE UTILIZATION OF NITROGEN-ORGANIC COMPONDS BY GASIFICATION

BACKGROUND OF THE INVENTION

1. Field of the Invention

The invention relates to a process for utilizing a feedstock comprising nitrogen-organic compounds to a useful end purpose. The feedstock is subjected to gasification at pressure and a temperature of at least about 900° C., using a gasifying medium containing free oxygen, the gasification being as a flame reaction in an entrained—bed gasifier. Apparatus for carrying out the process is provided as well. The invention can be used for the harmless utilization of nitrogen-organic compounds by gasification, generating a gas containing carbon monoxide and hydrogen.

2. Description of the Related Art

Nitrogen-organic compounds, and in particular residual and waste substances of the chemical industry, are to be understood as meaning mixtures of amines, nitrites or other nitrogen-containing hydrocarbons which could occur as waste substances or residues of the intermediate products of chemical syntheses but, for a wide variety of reasons, cannot be further processed directly, for example as mixed products.

It is known to incinerate carbon-containing residual and waste substances, utilizing the heat produced. If, however, such materials consist completely or partly of nitrogen-organic compounds, nitrogen oxides are formed to a great extent during the incinerating operation, pass into the atmosphere with the exhaust gases and contribute significantly to the acidification of rainwater. In recent years, a large number of catalytic and non-catalytic processes have been developed and leading in the case of high $NO_x$ concentrations, to considerable costs for the removal of the nitrogen oxides from the flue gas. The hot and voluminous amounts of flue gas require large dimensioning of the apparatus and equipment provided for the removal of the nitrogen oxides. An extensive summary of the prior art is provided by W. Fritz et al, "Reinigung von Abgasen" [cleaning of exhaust gases], Vogel Buchverlag, Würzburg 1992.

In the technique of gas generation, the gasification of fuels and of residual and waste substances which are in a free-flowing state, or can be transformed into this state, by partial oxidation in an entrained bed is known. In this case, the material being gasified and the gasifying medium, such as air, oxygen-enriched air or industrial oxygen, and optionally mixed with water vapor, and often also under increased pressure, are transformed in the form of a flame reaction into a gas rich in carbon monoxide and hydrogen. The raw gas produced under these conditions is used after appropriate cooling and cleaning as a synthesis gas or for energy-related purposes.

SUMMARY OF THE INVENTION

It is therefore the object of the invention to provide a way of harmlessly utilizing nitrogen-organic compounds which does not have the disadvantages of the prior art.

It has been found unexpectedly that, in spite of the highly reducing atmosphere present in the entrained-bed reactor, even under relatively high pressures, the nitrogen-organic compounds are oxidized to neutral nitrogen $N_2$. Further oxidation stages are not reached; therefore there are no detectable amounts of nitrogen oxides in the gasifying gas.

The expected formation of ammonia $NH_3$ due to the already described high reduction potential of the gasifying gas also surprisingly does not occur. The concentration of the ammonia in the gasifying gas is around the same level as that known from coal and oil pressure gasification.

The solution according to the invention provides a process for the utilization of a feedstock essentially comprising nitrogen-organic compounds in such a way that the utilization takes place by gasifying under normal pressure or increased pressure, it being advantageous to use a pressure of up to 40 bar. The temperatures during the gasifying process should be at least about 900° C. and preferably in the range of about 1100 to about 1600° C. as a suitable range for the partial oxidation using a gasifying medium containing free oxygen.

It is advantageous to perform the gasification by partial oxidation as a flame reaction in an entrained-bed gasifier.

It is also advantageous for the utilization of nitrogen-organic compounds to take place in the following technological stages: Feeding into an entrained-bed gasification. In this case it is advantageous to use an entrained-bed gasifier with a refractory-lined reactor chamber.

Taking place as the next stage is the partial cooling of the hot raw gas by spraying in water in the quenching process.

Provided as a further stage is a high-pressure steam generation further cooling the gas, then effecting, a gas COS hydrolysis, and a HCN hydrolysis, a desulfurization and a waste water treatment all being done in a succession downstream of the high-pressure stream generation.

It also is advantageous for ammonia separated in the waste water treatment to be returned to the gasifying reactor for disposal. In the process, different nitrogen-organic compounds are fed to the gasifying reactor together or separately and are gasified simultaneously. It is also possible with the process for organic and inorganic nitrogen compounds to be gasified together.

The apparatus for carrying out the process includes an entrained-bed gasifier into which a feedstock of nitrogen-organic compounds are fed, gasification of nitrogen compounds occurring in the entrained-bed gasifier. A quencher which cools and quenches the hot raw gas outletting the entrained-bed gasifier is located immediately downstream of the bed gasifier. A waste water treatment unit is connected by piping to the quencher so that spent or waste water used in the cooling and quenching of the hot raw gas can be delivered to the treatment unit. Next downstream of the quencher is a high-pressure steam generator through which the still heated raw gas passes for further cooling thereof and incident said cooling, steam being generated in the generator. The raw gas passes from the high pressure generator to a downstream hot-gas filter stage wherein certain fractions are filtered out of the gas before it passes next downstream to a COS/HCN hydrolysis unit. The raw gas then passes through a low-pressure steam generator for further cooling thereof following which there is still another cooling stage wherein the gas is cooled. The gas then is passed to a desulphurization stage for producing clean gas and sulphur draw off. A pipe connects the waste water treatment with the bed gasifier so that ammonia generated in waste water treatment can be returned to the gasifier for disposal.

The apparatus also includes piping providing that water outletting the low pressure stream generator and the low-pressure stream generator post cooling of the raw gas, be supplied upstream to the quenchers for use therein.

BRIEF DESCRIPTION OF THE DRAWINGS

The single FIGURE is a schematic representation of the present invention for gasifying nitrogen-organic compounds.

DETAILED DESCRIPTION OF THE PRESENTLY PREFERRED EMBODIMENTS

A total of 13,300 kg/h of nitrogen-organic compounds, mainly comprising nitrides and amines and occurring as residual substances in a nylon synthesis, are fed to the gasifying reactor 2 via feed systems 1. Apart from carbon, hydrogen, oxygen and sulfur, the residual substance contains an organically bonded nitrogen fraction of 1651 kg/h. Gasification with industrial oxygen in the entrained-bed reactor 2 provided with a refractory lining turns this into 13,134 $m^3$ STP/h of synthesis gas of the following composition:

| | | |
|---|---|---|
| $H_2$ | 4.2 | % by vol. |
| CO | 26.6 | % by vol. |
| $CO_2$ | 27.5 | % by vol. |
| $CH_4$ | 0.2 | % by vol. |
| N2 | 11.1 | % by vol. |
| HCN | 0.04 | % by vol. |
| $NH_3$ | 0.28 | % by vol. |

The following are formed from the organically bonded nitrogen fraction of 1651 kg/h:

| | | |
|---|---|---|
| $N_2$ | 11.10 | % by vol. |
| HCN | 0.04 | % by vol. |
| $NH_3$ | 0.27 | % by vol. |

The chemically bonded nitrogen present in the form of HCN and $NH_3$ in the synthesis gas amounts to 24.9 kg/h, but this only constitutes 0.18% of the value introduced.

The hot raw gas enters the quenching stage 3 from the gasifying reactor at a pressure of 25 bar and a temperature of approximately 1300° C.

In the quenching stage, the hot raw gas is cooled to about 800° C. by the quenching stage water spray. Depending on the subsequent gas treatment technology, the raw gas is cooled by excess water to the dew point of approximately 200° C. The very low ash content of the nitrogen-organic residual substance in this case allows the partial quenching to 800° C., so that in the downstream high pressure steam generator 4, high-pressure steam can be generated with the still heated raw gas. The use of the raw gas for steam generation further cools it. Before the raw gas outletting steam generator 4 passes into the catalytic COS and HCN hydrolysis stage 6, certain material fractions in dust form present in the gas are removed in a hot-gas filter 5 as a catalyst protection measure. From the hydrolysis stage 6, the raw gas passes into a low-pressure steam generator 7 where more cooling of the gas occurs. It will be understood that the heat exchange occurring in the low-pressure-generator will produce water condensates from the raw gas, this condensate being recycled to the quencher 3. The same is true of water condensates produced in cooler 8. Still further cooling takes place in cooler 8, which is supplied with cooling water for that purpose, ammonia being removed from the raw gas by its dissolving in the raw gas condensates. The gas is then subjected to desulphurization at stage 9, clean gas 10 resulting from such, being passed on for an intended utilization. Sulphur 11 is drawn off from the desulfurization stage 9 in elementary form. The ammonia-containing condensates are recycled back to the partial quenching 3. The excess condensate passes into the waste water treatment 12, in which, inter alia, the ammonia is separated off. This ammonia is returned to the gasifying reactor 2 via the line 13 for disposal.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

The invention is not limited by the embodiments described above which are presented as examples only but can be modified in various ways within the scope of protection defined by the appended patent claims.

We claim:

1. A process for the utilization of feedstock essentially including nitrogen-organic compounds, said process comprising:

feeding the feedstock into an entrained-bed gasifier along with a gasifying medium containing free oxygen to gasify the nitrogen-organic compounds by partial oxidation thereof as a flame reaction in the gasifier at a pressure of up to about 40 bar and a temperature of at least about 900° C. therewith to oxidize the nitrogen in the nitrogen-organic compounds to a neutral nitrogen form.

2. The process as claimed in claim 1, in which the nitrogen-organic compounds are gasified at a temperature in a range of about 1100° C. to about 1600° C.

3. The process as claimed in claim 2, in which the utilization includes the feeding of the feedstock into a bed gasifier which is lined with refractory material and additionally comprises the sequential stages of:

subjecting hot raw gasified gas outletting the entrained-bed gasifier to at least a partial cooling in a quencher by spraying water on said gas;

using the raw gas to generate high pressure steam in a steam generator therewith further cooling said raw gas;

conducting separate ones of a COS hydrolysis, and a HCN hydrolysis of the raw gas;

subjecting the raw gas to a desulphurization operation to draw off sulphur from the raw gas and thereby produce a clean gas; and directing waste water from the quencher to a waste water treatment operation, and separating ammonia generated in the waste water treatment operation from said waste water.

4. The process as claimed in claim 3, in which the ammonia separated in the waste water treatment operation is returned to the gasifier for disposal.

5. The process as claimed in claim 1, in which different ones of nitrogen-organic compounds are fed to the gasifier in one of separate feeds of said different compounds, and a common feed of said compounds for a simultaneous gasification of said compounds.

6. The process as claimed in claim 1, wherein the nitrogen-organic compounds of the feedstock are substances which could occur as waste substances or residues of the intermediate products of chemical synthesis.

7. The process as claimed in claim 1, wherein the nitrogen-organic compounds include a mixture including at least one of amines, nitriles, and other nitrogen-containing hydrocarbons.

* * * * *